US008033308B2

(12) United States Patent
Stager

(10) Patent No.: US 8,033,308 B2
(45) Date of Patent: Oct. 11, 2011

(54) DOUBLE-SIDED WEAR INSERT FOR A CHIPPER

(75) Inventor: Bradley R. Stager, Beaverton, OR (US)

(73) Assignee: Key Knife, Inc., Tualatin, OR (US)

( * ) Notice: Subject to any disclaimer, the term of this patent is extended or adjusted under 35 U.S.C. 154(b) by 869 days.

(21) Appl. No.: 11/651,116

(22) Filed: Jan. 8, 2007

(65) Prior Publication Data

US 2008/0166189 A1 Jul. 10, 2008

(51) Int. Cl.
*B27C 1/00* (2006.01)

(52) U.S. Cl. ..... 144/230; 144/176; 241/92; 241/298; 407/2

(58) Field of Classification Search ..... 144/230, 144/231, 241, 176, 162.1, 172–174, 220; 241/92, 176, 298, 296, 278, 294; 407/2, 407/40, 46, 100, 115
See application file for complete search history.

(56) References Cited

U.S. PATENT DOCUMENTS 3,542,302 A 11/1970 Salzmann, Jr.
3,981,337 A 9/1976 Sundstrom
4,047,670 A 9/1977 Svensson
4,059,884 A * 11/1977 Weill ..... 29/402.13
4,082,128 A * 4/1978 Barke et al. ..... 144/230
4,298,044 A 11/1981 Hansel et al.
4,349,057 A * 9/1982 Bachmann et al. ..... 144/230
4,423,758 A 1/1984 Haller et al.
4,503,893 A * 3/1985 Demopoulos ..... 144/176
4,694,995 A 9/1987 Holmberg et al.
4,754,789 A 7/1988 Jonsson
4,771,718 A * 9/1988 Carpenter et al. ..... 144/176
4,850,408 A 7/1989 Carpenter et al.
4,889,025 A * 12/1989 Collett ..... 83/835
5,271,440 A 12/1993 Bradstreet, Jr. et al.
5,271,442 A * 12/1993 Carpenter et al. ..... 144/220
5,333,659 A 8/1994 Carpenter
5,348,065 A 9/1994 Meyer
5,469,902 A 11/1995 Sharp et al.
5,819,826 A 10/1998 Schmatjen
5,820,042 A * 10/1998 Robison ..... 241/92
5,904,193 A * 5/1999 Kellner ..... 144/230
5,979,522 A 11/1999 Swartwood et al.
5,996,655 A * 12/1999 Cramond et al. ..... 144/176
6,056,030 A * 5/2000 Jonkka ..... 144/176
6,202,721 B1 * 3/2001 Stegmaier ..... 144/230
6,591,878 B2 * 7/2003 Hinchliff ..... 144/241
6,848,486 B2 * 2/2005 Heikkinen ..... 144/368
6,953,167 B2 * 10/2005 Strong ..... 241/92
RE38,930 E * 1/2006 Swartwood et al. ..... 144/176
7,134,622 B2 * 11/2006 Biller et al. ..... 241/92
7,140,408 B1 11/2006 Hinchliff et al.
7,409,972 B2 * 8/2008 Haapasalo ..... 144/174
2003/0086766 A1 * 5/2003 Andras ..... 407/102
2004/0089754 A1 5/2004 Strong

OTHER PUBLICATIONS

International Search Report and Written Opinion of the International Searching Authority, PCT/US2007/001992.

* cited by examiner

*Primary Examiner* — David J. Walczak
*Assistant Examiner* — Jennifer C Chiang
(74) *Attorney, Agent, or Firm* — Portland Intellectual Property, LLC

(57) ABSTRACT

A double-sided wear insert, for a knife assembly that includes a knife, a clamp, and a holder. In one embodiment, the wear insert can be turned end-for-end, and in another embodiment the wear insert can be flipped up-side down, to double the service life of the part.

44 Claims, 6 Drawing Sheets

DOUBLE-SIDED WEAR INSERT FOR A CHIPPER

FIELD OF THE INVENTION

The present invention relates to a wear insert for a disc, drum or conical head style chipper.

BACKGROUND

Disc, drum, and conical head chippers are basic equipment in sawmills, used for processing logs into useable lumber. They employ revolving chipper heads in either disc, drum, or conical configurations to which, typically, a number of knives are attached. In a disc chipper (or chipper disc) the knives may be attached to the periphery of the disc or the sides of the disc. In drum and conical head chippers, the knives are attached to the periphery of the drum. Any of these chippers will be referred to hereinafter simply as a "chipper," and either a disc, drum, or conical head will be referred to simply as a "cutting head" or "head."

The knives are typically clamped to the head between a pair of clamping members, an "outer" or "upper" clamping member, and an "inner" or "lower" clamping member that is attached to the base of the chipper. The knife has front and back sides, the former facing the direction of rotation of the head. The upper clamping member contacts the back side and the lower clamping member contacts the front side, clamping the knife therebetween.

The wood article to be chipped by the chipper is fed into the chipper at a given feed speed, the cutting head revolves at a given rotational speed, and the knives have a given knife density, i.e., they are angularly spaced apart from one another on the head a given amount. These three parameters determine the size, particularly the length, of the chips. While the wood article is chipped fundamentally to shape it into useable lumber, the chips themselves have economic value as components of engineered or manufactured wood products, such as pulp and paper, fiberboard, and oriented strand board.

The knife is typically removed from the chipper head by removing the upper clamping member. In some more advanced prior art systems, the knife can be removed by a threaded adjustment that pivots the lower clamping member, such as described in Swartwood et al., U.S. Pat. No. 5,979,522.

FIG. 1 shows, in cross-section, a generic knife assembly 2 for clamping a chipper knife. The knife assembly 2 is mounted to a chipper head 4. The assembly has four main components, a knife 5, an upper clamping member (or "clamp") 6, a lower clamping member (or "holder") 7, and a replaceable wear insert 8. The clamp 6 and holder 7 clamp the knife, and a bolt 11 passes through the clamp and into, or through, the holder.

The assembly rotates in the direction "R." The knife has a front side 3 and a back side 4, the front side facing the direction of rotation R. Chips cut by the knife follow the path "P" and contact a wear surface 9 of the wear insert 8. The wear surface becomes worn as a result of this contact. The wear surface, since it is closest to the knife, experiences more wear than the holder 7.

The wear insert 8 is substantially smaller (less massive) than the holder 7. For this reason, and because the greatest amount of wear occurs in the localized area of the wear insert, it is economically advantageous to provide, in addition to the holder 7, the wear insert as a disposable part. The wear insert is also, typically, substantially smaller than the clamp. The wear insert may or not be bolted to the holder; however, it is not bolted to the clamp.

The wear insert is typically provided with a "wear coating," that is applied to and hardens the wear surface 9. One example is referred to more particularly as a "hardsurface," which results from hardsurfacing, i.e., the application to the wear surface 9 of a diamond carbide powder coating. With a wear coating, the wear surface is harder or more wear resistant than the tool steel of which it, and particularly the holder, is formed. Alternatively, the entire wear insert may be formed of a harder or more wear resistant material.

The term "counterknife" is sometimes used to refer to a wear insert. However, a counterknife is defined more generally as a part used for breaking and deflecting chips cut by the knife, and the term has consequently been applied to holders in assemblies that do not contain a separate wear insert. Herein, the term wear insert is used to refer to a specific, relatively small component of an assembly like the assembly 2.

FIG. 2 shows two important parameters relating the knife 5 and wear insert 8. The impact angle θ determines the "impact" of the cutting head on the chips. In a "high impact" configuration, θ=90 degrees and the wear surface 9 is a blunt obstacle to chip flow. To provide lower impact configurations, θ is increased resulting in a more gentle path for chip flow. It is desired to break the chips with only as much force as is necessary, to minimize wear and damage to the chips, so the impact angle is adjusted for various factors, including the strength of the wood being chipped.

The other important parameter shown in FIG. 2 is the depth "D" of the wear insert relative to the cutting edge CE of the knife. This parameter is adjusted to be appropriate for the chip length mentioned above.

Referring back to FIG. 1, the wear insert 8 is indexed to the holder 7 by a side of the wear insert 10*a* abutting the holder at a seat 10*b* of the holder. As the insert wears and the wear surface 9 erodes, the surface retreats in the direction of the seat 10*b* and the depth D is undesirably increased. When the wear has become unacceptable, the wear insert is removed and either the wear surface renewed or the part replaced.

It may be noted that the above discussion is based on a simplifying assumption that the knife does not wear appreciably relative to the wear insert. This is generally not true, so the actual relationship between wear of the wear insert and the depth parameter "D" is of course more complex than indicated.

Providing the wear insert, especially as a disposable part in a knife assembly like the assembly 2, is economical, however, it remains that the part must be replaced or reworked at intervals, and it would be desirable to increase the service life of the wear insert.

SUMMARY

A double-sided wear insert. The wear insert is for use in a knife assembly that includes a knife, a clamp, and a holder. Wear inserts according to the invention can either be turned end-for-end, of flipped up-side down, to double the service life of the part. Four more particular embodiments are summarized as follows.

In first, second and third embodiments, the wear insert includes two planar wear surfaces at opposite sides thereof. In the first and second embodiments, the wear insert defines at least one of (a) a plane about which the wear surfaces have reflective symmetry or (b) an elongate axis of the wear insert about which the wear surfaces have 180 degree rotational symmetry. More particularly, in the first embodiment, the wear surfaces define equal impact angles that differ substantially from 90 degrees, and in the second embodiment, the wear surfaces are harder or more wear resistant than at least some portions of the holder.

In the third and fourth embodiments, the wear insert has an upper side for contacting the knife and an opposite, lower side that is received by the holder. More particularly, in the third embodiment, the lower side includes a holder-indexing feature that includes at least one of (a) a projection and (b) a recess for indexing the wear insert to the holder, and in the fourth embodiment, the upper side includes at least one knife-indexing feature that defines in cross-section a contour that is a smoothly varying arc, for indexing the knife. Consistent with either turning the wear insert, or flipping the wear insert, either the upper surface has two of the knife-indexing features, in which case the knife-indexing features have reflective symmetry, or both the upper and lower surfaces have one of the knife-indexing features, in which case the knife-indexing features have 180 degree rotational symmetry.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

Reference will now be made in detail to specific preferred embodiments of the invention, examples of which are illustrated in the accompanying drawings.

Figure 3:
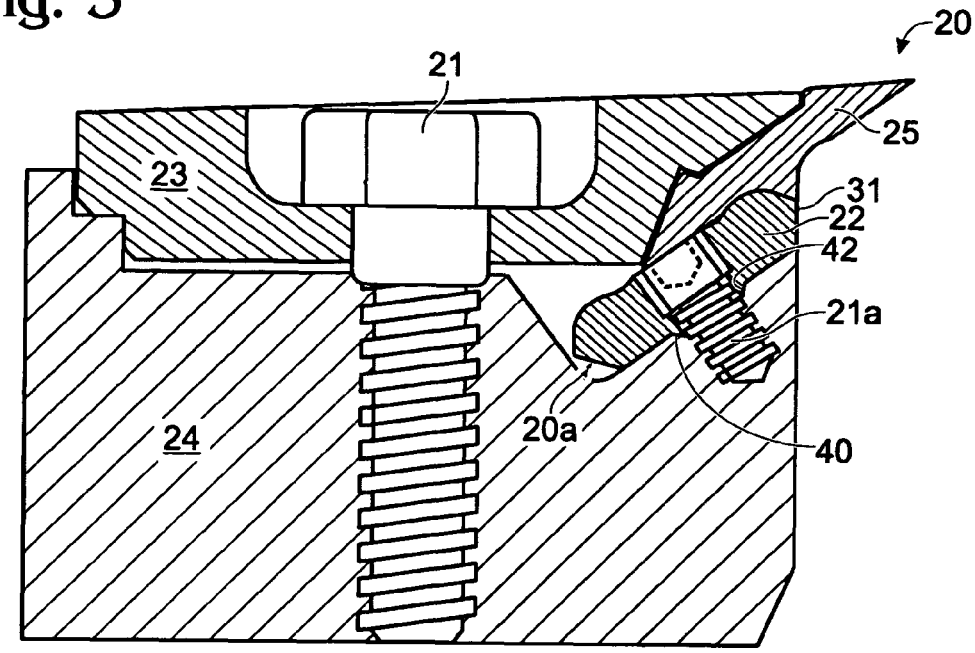
FIG. 3 is a cross-sectional view of a first knife assembly including a preferred double-sided wear insert according to the present invention.

Referring to FIG. 3, a knife assembly 20 for use with a chipper head is shown having a knife 25, a clamp 23, and a holder 24 and a double-sided wear insert 22 according to the present invention. The clamp and holder clamp the knife therebetween by the use of clamping bolts 21 passing through the clamp and into or through the holder.

Figure 1:
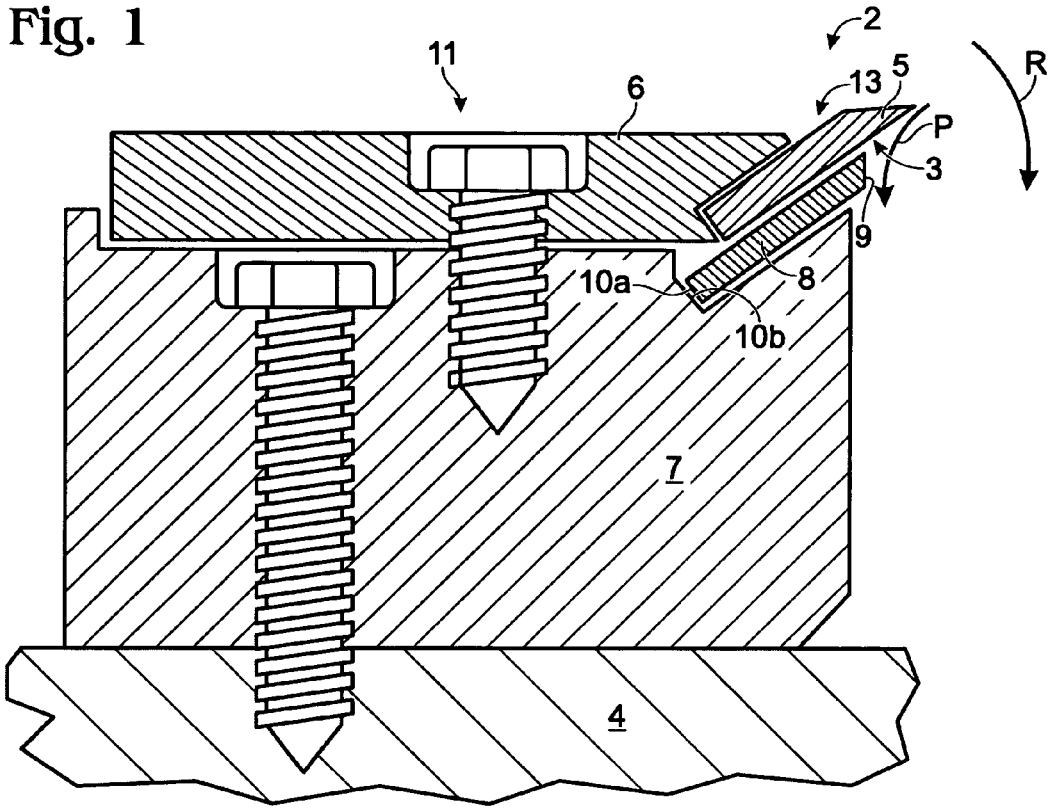
FIG. 1 is a cross-sectional view of a generic, prior art knife assembly.
Figure 2:
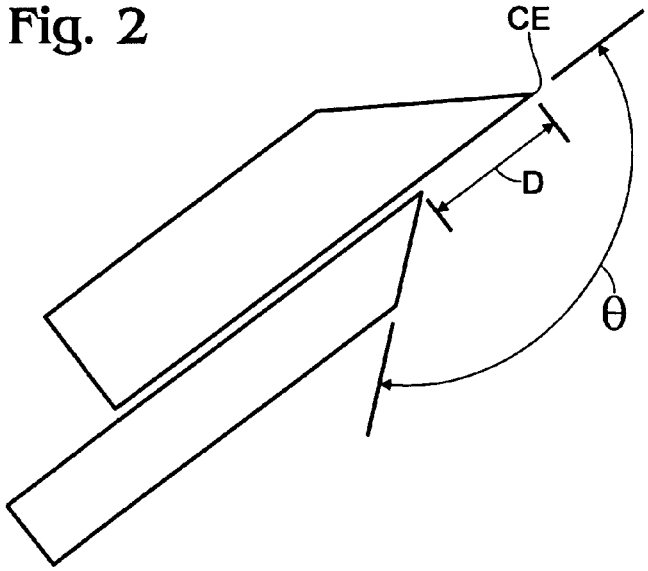
FIG. 2 is a cross-sectional view of knife and wear insert components of the assembly of FIG. 1.

The wear insert 22 is of the same general type of component as the wear insert 8 described above in connection with FIGS. 1 and 2. It is substantially less massive than the holder 24, typically about ⅙ of the mass of the holder, and in this example is bolted to the holder by use of a mounting bolt 21*a*. The wear insert 22 is disposed between the knife 25 and the holder 24, and it is characteristic of a wear insert, because of its relatively small size, that it does not make contact with the clamp 23.

Preferably, at least a wear surface 31 of the wear insert that is proximate the knife 25 is harder or more wear resistant than the holder. This is because the wear insert is exposed to the greatest chip quantity and impact velocity and is therefore subject to the most wear. It should be understood that, while having a higher hardness generally ensures a greater wear resistance, it is possible to provide a higher wear resistance without increasing the hardness, and a material may provide a greater wear resistance despite a decrease in hardness.

It is also generally, though not necessarily, the case that the wear insert 22 is substantially less massive, and that the wear surface 31 is harder or more wear resistant than the clamp 23.

In the preferred embodiment of the wear insert 22, the wear surface 31 is provided with a wear coating to produce a hardness or wear resistance that is greater than that of the material of which the holder is formed. Typically, the holder and clamp are formed of tool steel, and the wear coating provides a hardness of about 63-65 Rockwell C. A preferred alternative is to form the entire wear insert of a harder or more wear resistant material than that of which the holder is formed, such as a tool steel that has been heat treated to provide a hardness in the above-mentioned range. However, though it is desirable, it is not essential that the wear insert be made any harder, or more wear resistant, than the holder or the clamp.

While one wear surface 31 is indicated in FIG. 3, it is an outstanding advantage of the invention that a single wear insert provides at least two, selectable wear surfaces as described below.

Shown in the knife assembly 20 is a preferred knife 25. The knife 25 will be described in greater detail below, however, it should be immediately understood that a double-sided wear insert according to the present invention may be used in conjunction with any prior art or future developed knife.

Figure 4:
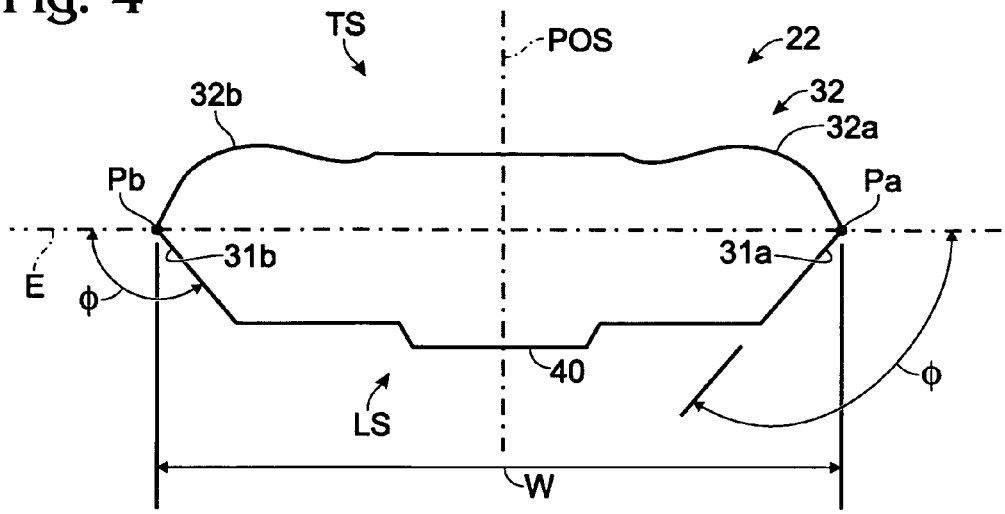
FIG. 4 is a cross-sectional view of the preferred double-sided wear insert component shown in FIG. 3.

FIG. 4 shows the preferred wear insert 22 apart from the assembly 20. The wear insert has an elongate cross-section (as shown), an upper side "TS" that faces the knife 25 and a lower side "LS" that is received by the holder 24.

The wear insert 22 is entirely symmetric about a plane of reflective symmetry "POS." A line "E" perpendicular to POS and lying in the plane of the Figure defines an elongate (as shown in cross-section) direction or axis of the wear insert. The line E shown intersects two points "Pa" and "Pb" at opposite sides of the wear insert that have reflective symmetry about POS and, in this embodiment, define the maximum width "W" of the wear insert 22.

As mentioned, two wear surfaces 31, namely 31*a*, 31*b*, are provided, at the opposite sides of the wear insert. One of the wear surfaces (31*a*) is positioned below the knife 25 for active use, while the other wear surface (31*b*) is stowed within the knife assembly 20. When the wear surface 31*a* becomes worn to an unacceptable degree, the wear insert 22 is removed, turned end-for-end (referred to herein as "turning"), and replaced to expose the previously stowed wear surface 31*b*. This provides the outstanding advantage of doubling the use that can be obtained from the wear insert 22 before it must be renewed, reworked, or disposed of.

The wear surfaces 31 are planar, but this is not essential. Preferably, the wear surfaces 31*a*, 31*b* are substantially or essentially identical. And typically, as is shown in FIG. 4, both wear surfaces define the same impact angle θ described above in connection with FIG. 2 relative to the axis E. The impact angles are considered equal on both sides of the wear insert for all purposes herein where the same angle is obtained from the wear insert when the wear insert is turned.

Impact angles are provided as desired according to known criteria, and it is intended that a number of different wear inserts having different impact angles may be used in the same knife assembly. It is not essential that the wear surfaces 31 of the same wear insert define the same impact angle, and it may be advantageous to provide different impact angles to allow for a predetermined adjustment of impact angle.

Figure 5:
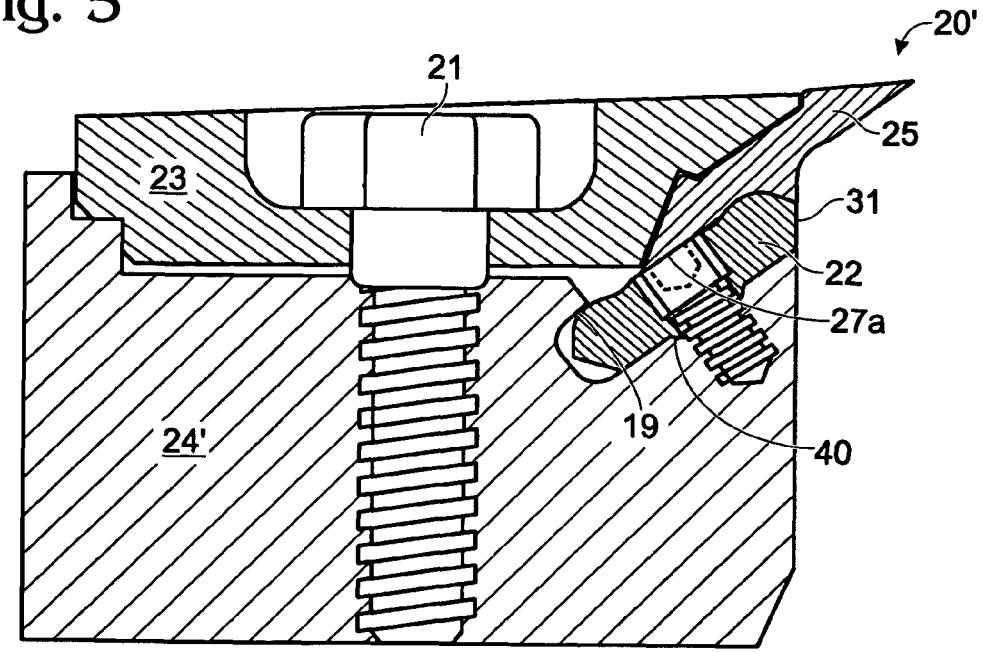
FIG. 5 is a cross-sectional view of a second knife assembly including the double-sided wear insert of FIG. 3.

FIG. 5 shows a knife assembly 20' like the knife assembly 20 except that a variation of the holder 24, i.e., 24' is used. The holder 24' includes a land 19 that contacts the end of the wear insert that is stowed within the assembly, to further stabilize it. The knife 25, however, preferably does not actually contact the wear insert 22 along a planar knife-edge-joining portion 27*a* of the knife, in either the assembly 20 or the assembly 20' (this feature is shown more clearly in FIG. 14).

Returning to FIG. 4, the upper side TS of the wear insert 22 includes identical knife-indexing features 32, namely 32*a* and 32*b*, that conform to and are therefore defined by complementary shaped indexing features 30 (FIG. 3) of the knife, described below. While a particular complementary pair of shapes is shown, any other complementary shapes could be used. While the wear insert 22 is entirely symmetric about the plane of symmetry POS, this is not essential. Regardless, it is independently desirable that the knife-indexing features 32 be symmetric about POS, to retain the same location of the wear surface relative to the knife after turning the wear insert. This is because (a) the knife is preferably also double-sided with two cutting edges, and symmetric about its own plane of reflective symmetry, so that the knife installed with either cutting edge in an active position may be used with the wear insert installed with either wear surface in an active position, and (b) even if the knife is not symmetric, the wear insert can be turned without changing or turning the knife.

The lower side LS includes a holder-indexing feature 40 that conforms to and is therefore defined by a complementary shaped indexing feature 42 (FIG. 3) of the holder. While a particular complementary pair of shapes is shown, any other complementary shapes could be used, and the indexing feature 40 may include a projection or recess, or both. The provision of the holder-surface indexing feature 40 is an outstanding advantage of the invention, facilitating practical use of the two wear surfaces 31. Particularly, it has been determined that an end of the wear insert, because it is defined by a wear surface, does not provide acceptable indexing when abutted against a corresponding seat in the holder as in the prior art. This is due partly to the fact that the wear surface 31 can be at any desired impact angle and therefore will not generally be at the same angle as the seat, and partly to the fact that, preferably, the wear surface has a wear coating, and is most preferably hard surfaced, which leaves the wear surface loosely toleranced. Accordingly, as shown in FIG. 3, the side 22*a* of the wear insert that is stowed within the knife assembly 20 is spaced from the holder 24 to accommodate this tolerance.

The holder-indexing feature 40 is also symmetric with respect to the plane POS so that each wear surface will occupy the same active position when the wear insert is turned.

Details regarding the preferred knife 25 are provided next. It should be understood that while preferred, it is not essential to the invention to use a knife having the particular features disclosed herein. The knife 25 with the features described herein is preferable, however, for reasons that will be explained.

Figure 8:
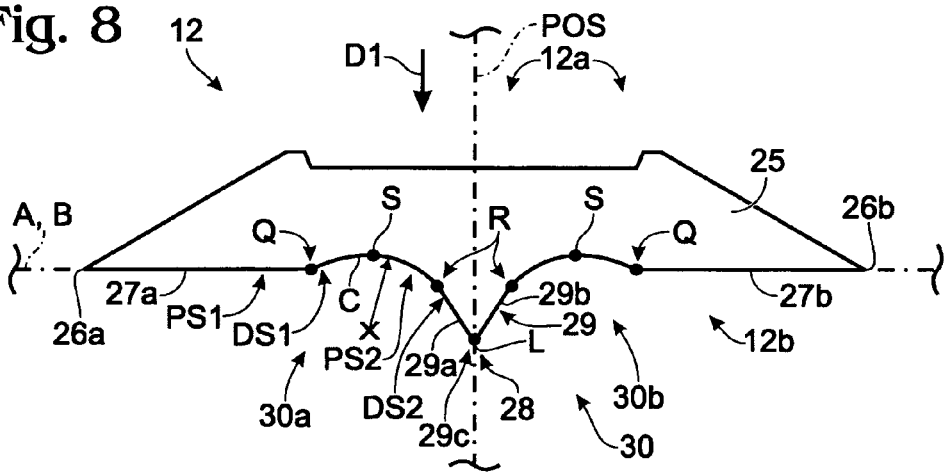
FIG. 8 is a cross-sectional view of the knife of FIG. 6, taken along a line 8-8 thereof.
Figure 6:
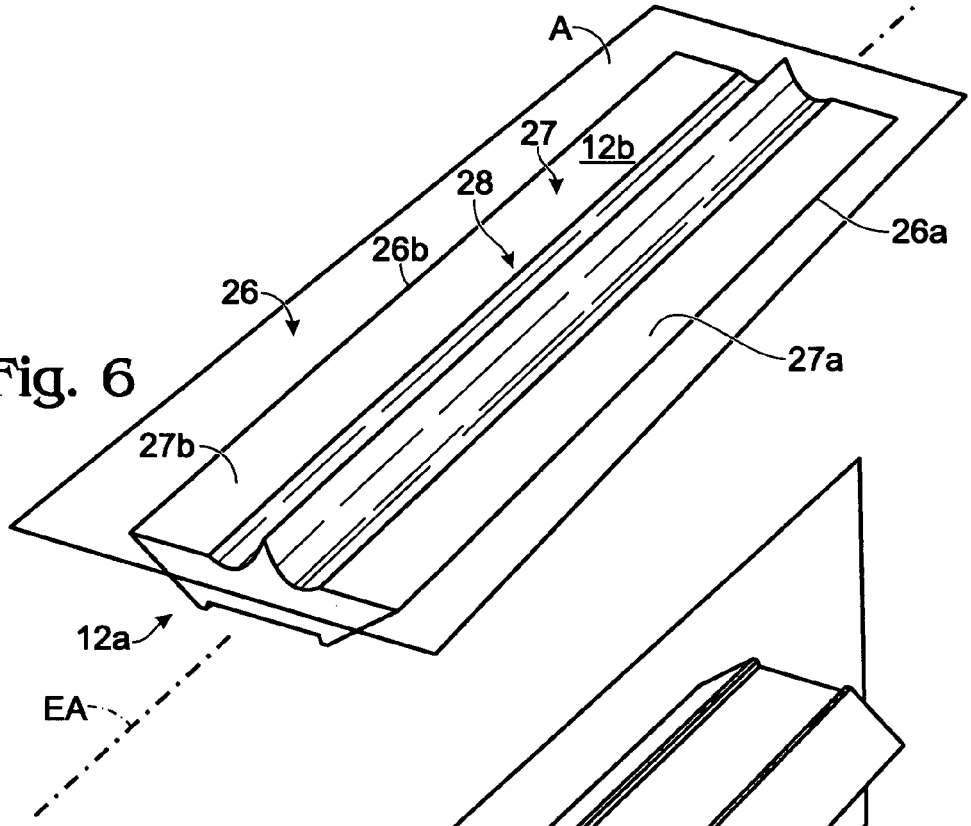
FIG. 6 is a back-side isometric view of the preferred knife component shown in FIG. 3.
Figure 7:
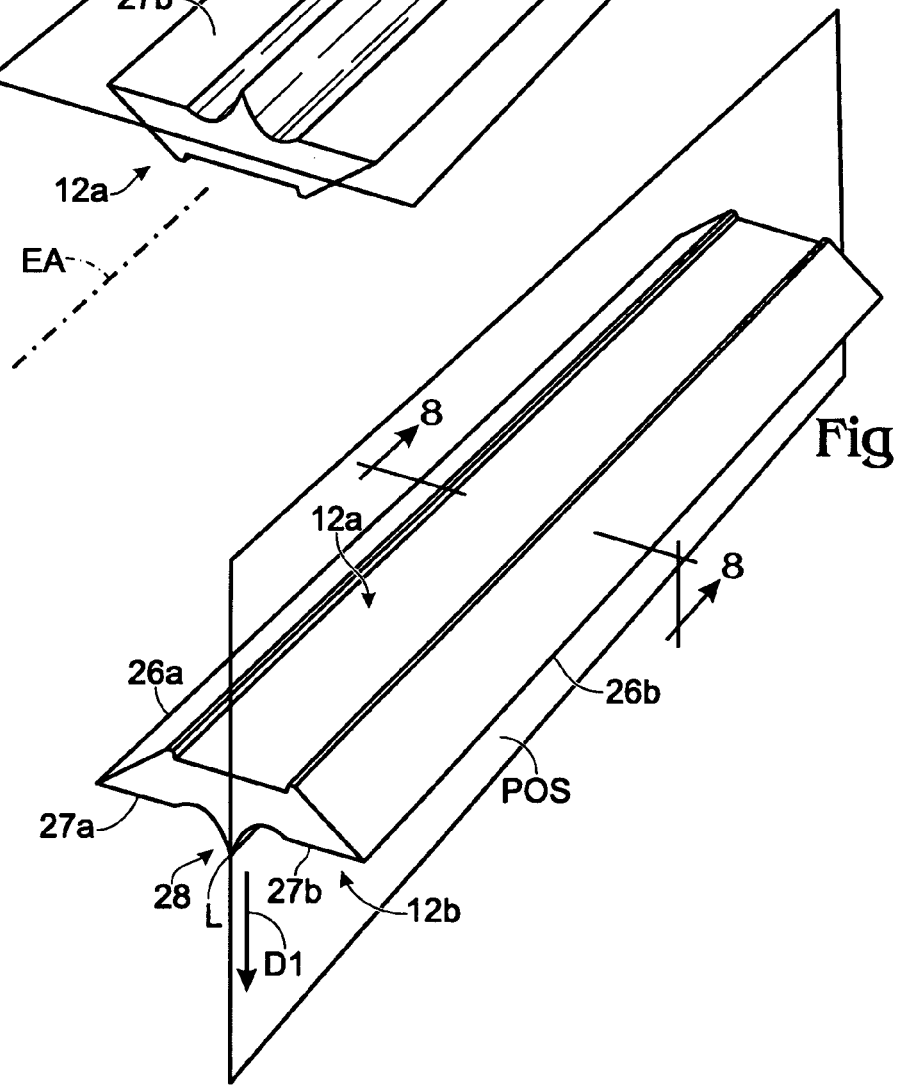
FIG. 7 is a front-side isometric view of the knife of FIG. 6.

The knife 25 is shown in perspective in FIGS. 6 and 7, and in cross-section in FIG. 8. The knife has a back side 12*a* and a front side 12*b*. As will be understood by persons of ordinary skill, the front side 12*b* faces the direction of rotation of the cutting head, and for purposes herein, a vector pointing from the back side toward the front side will be considered to point in a "positive" direction.

Figure 9:
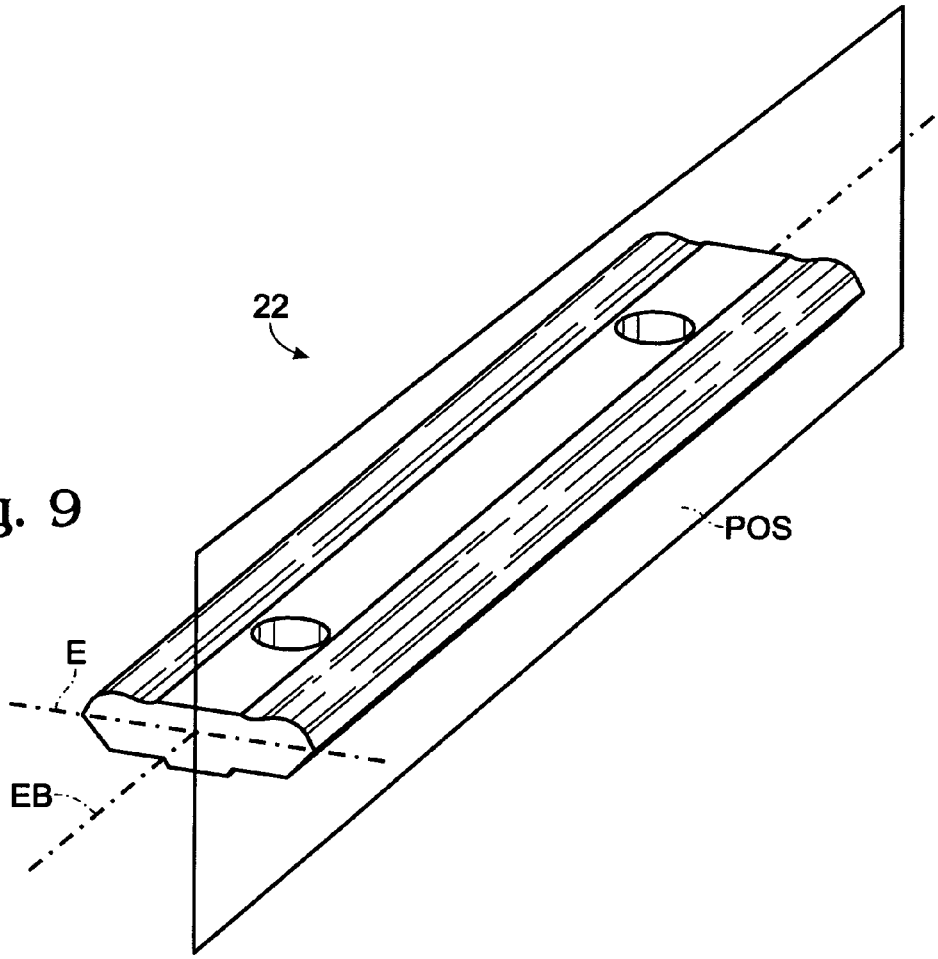
FIG. 9 is an upper-side isometric view of the wear insert of FIGS. 3 and 4.

The knife is elongate along an axis "EA" and has the cross-section shown in FIG. 8. By comparison, with reference to FIG. 9, the wear insert 22 is similarly elongate along an axis "EB" and has the cross-section shown in FIG. 5. The knife has a plane of reflective symmetry "$POS_{knife}$," comparable to the plane of reflective symmetry POS of the wear insert. With this symmetry, the knife 25 can be removed from the assembly 20, turned end-for-end to provide a fresh cutting edge, and reinstalled. The line E described above lies in a reference plane "B" shown in FIG. 9 which is analogous to the reference plane "A" shown in FIG. 8. These reference planes are perpendicular to the respective planes of reflective symmetry.

As shown in FIG. 8, the knife has two parallel cutting edges 26 lying in the reference plane A, the edges referenced as 26*a* and 26*b*. The front side 12*b* includes two substantially planar knife-edge-joining portions 27, namely 27*a* and 27*b* that may also lie in the plane A, but which may be disposed at non-zero angles with respect to the plane A if desired. For example, even if the knife-edge-joining portions are originally provided to lie in the plane A, these surfaces may be ground as known in the art to alter the attack angle of the knife 25.

Between the knife-edge-joining portions 27, and projecting from the front side 12*b* of the knife 12, is a single deflector ridge 28. The deflector ridge 28 reaches a linear edge or line of points "L" of greatest maximum projection of the knife in the direction "D1" indicated by the arrow (FIGS. 7, 8), from the plane A, the line lying in the plane of reflective symmetry "$POS_{knife}$" of the knife.

With particular reference to FIG. 8, the deflector ridge 28 has two canted outer surfaces 29, namely 29*a* and 29*b*, joining at an apex 29*c* that is preferably sharp, but which in typical practice is slightly rounded-off, and where the amount of such rounding is not particularly important. The outer surfaces 29 may be substantially planar as shown, or may be concave and, preferably, smoothly curving.

The deflector ridge 28 provides, in the outer surfaces 29, a guiding surface for efficiently guiding cut chips away from the apparatus. This guiding action also reduces wear of the wear insert 22 as a result of preventing some contact with the chips that would otherwise occur. Further, a single deflector ridge may be made larger than the corresponding deflector ridges of a deflector ridge pair, as had been previously provided in the prior art, without any additional metal being required. This provides for a stronger deflector ridge that is also more capable of providing the aforedescribed functions with no increase in the weight of the knife 25. It also provides for a stronger knife by distributing more metal farther from the neutral axis, as in an I-beam.

The front side 12*b* of the knife 25 includes a pair of indexing features 30, namely 30*a* and 30*b*, as mentioned above. The indexing features 30 help, along with the deflector ridge 28, to index the knife to the wear insert 22 also as discussed above.

Each indexing feature 30 is disposed between the corresponding knife-edge-joining portion 27*a*, 27*b* and the deflector ridge 28. That is, distal sides "DS1" of the indexing features 30 merge with proximal sides "PS1" of the knife-edge-joining portions 27 at points "Q," and proximal sides "PS2" of the indexing features 30 merge with distal sides "DS2" of the outer surfaces 29 of the deflector ridge 28 at points "R."

Due to the symmetry of the knife, the points Q on both sides of the plane of symmetry POS define a plane "B," which in this example is coincident with the plane A but need not be as mentioned above. The orientation of the knife shown in FIG. 8 is a drawing convention in which the front side of the knife is at the bottom of the Figure, so that the positive direction "D1" is downward. The indexing features 30 describe re-entrant contours "C" that intersect the plane B at points Q, and points "S" on these contours are points of minimum projection of the front side 12*b* of the knife with respect to the positive direction D1.

This re-entrant disposition of the indexing features 30 provides the advantage of tucking the indexing features up and out of the way of chip flow so that, as the knife-edge-joining portions wear, the indexing features remain in substantially un-worn condition.

Further, each contour C is preferably shaped as a concave, smoothly varying arc that smoothly merges with the corresponding outer surface 29*a*, 29*b* of the deflector ridge 28. In correspondence, the complementary feature 32 of the wear insert 22 is a convex, smoothly varying arc. More preferably, these arcs are circular, which is found to provide for maximally robust registration of the knife.

Figure 10:
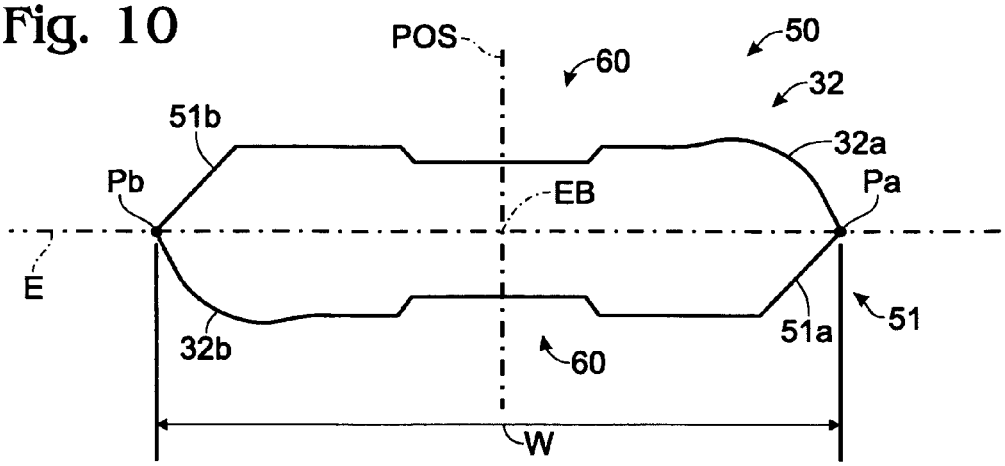
FIG. 10 is a cross-sectional view of an alternative wear insert according to the invention that differs from the wear insert of FIG. 5 in that it provides for flipping, rather than turning, of the wear insert to provide fresh wear surfaces.

Thus far, a wear insert having wear surfaces that are symmetric about a plane of reflective symmetry has been shown and described as preferred. This allows for turning the wear insert end-for-end to provide a change of wear surfaces. However, it essentially the same functionality may be provided in a wear insert having 180 degree rotational symmetry about the elongate axis EB. This allows for "flipping" the wear insert up-side down to provide the change of wear surfaces. FIG. 10 shows such a wear insert 50 for comparison with the wear insert 22 of FIG. 4.

The wear insert 50 has wear surfaces 51, namely 51*a* and 51*b* that have 180 degree rotational symmetry instead of reflective symmetry, though they could also have reflective symmetry under certain circumstances.

The upper and lower sides TS and LS are identical and are also symmetric with respect to 180 degree rotations about the elongate axis EB. Knife-indexing features 52, namely 52*a* and 52*b*, are shaped to fit the knife as for the corresponding features 32 of the wear insert 22.

Figure 11:
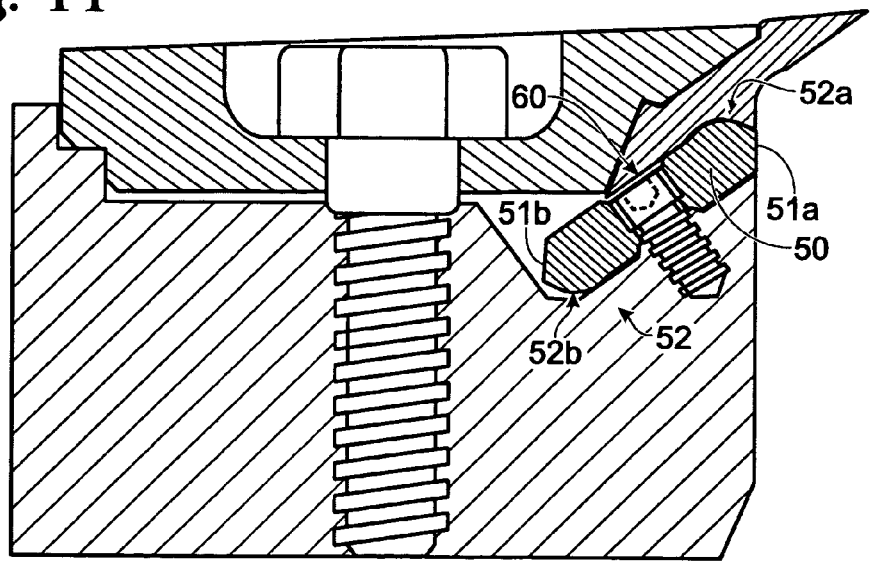
FIG. 11 is a cross-sectional view of the knife assembly of FIG. 3 with the wear insert of FIG. 10 substituted for the wear insert of FIG. 3.

Identical holder-indexing features 60 are provided on both the upper and lower sides of the knife to accommodate flipping the wear insert and registering the wear surfaces 32*a* and 32*b* in the same position in the knife assembly. With additional reference to FIG. 11, it will be appreciated that these features are recesses rather than projections to avoid interference with the knife 25. However, projections could be used where the knife has an accommodation for them.

Figure 12:
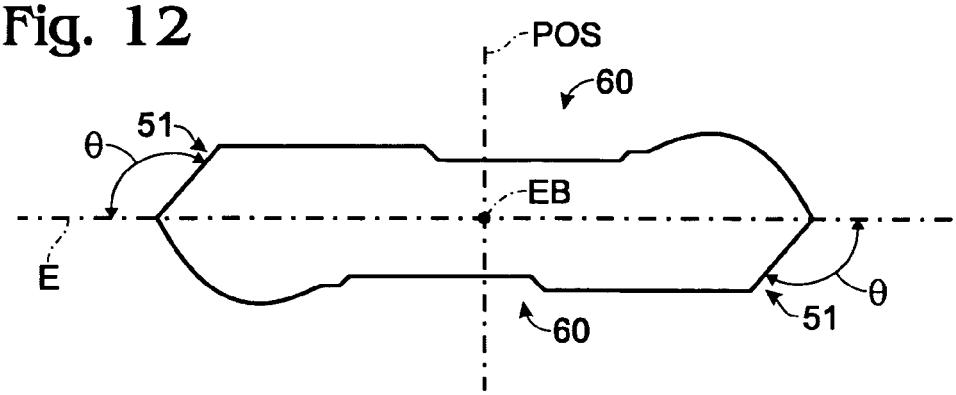
FIG. 12 is a cross-sectional view of another alternative wear insert that illustrates a variation of the wear insert of FIG. 10.

While the holder-indexing features 60 are shown as being symmetric about a line perpendicular to the line E that intersects the axis EB, it will be readily appreciated that reflective symmetry of the holder-indexing features is not important in this embodiment. For example, FIG. 12 shows the wear insert 50 with the same basic configuration of the holder-indexing features without reflective symmetry but retaining the required 180 degree symmetry. The impact angles θ for the wear surfaces 51 are defined as indicated in FIG. 12.

Figure 13:
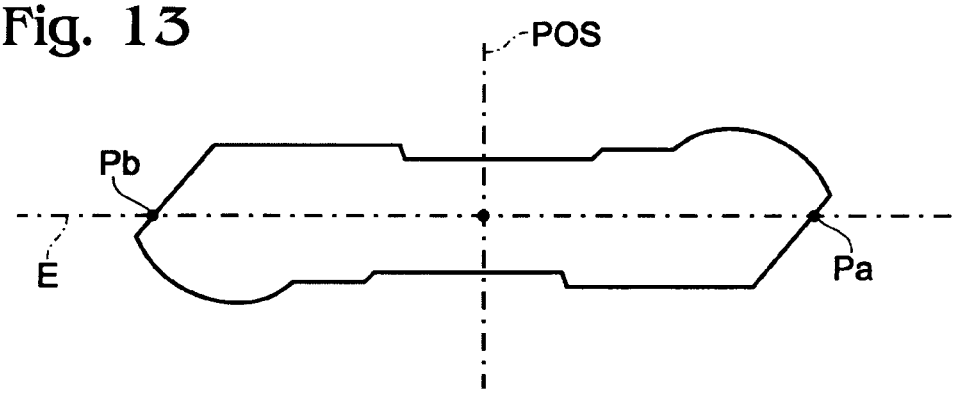
FIG. 13 is a cross-sectional view of yet another alternative wear insert that illustrates another variation of the wear insert of FIG. 10.

FIG. 13 shows another variation of the wear insert 50 illustrating a circumstance in which points Pa and Pb defining the line E as defined above do not define the maximum width of the wear insert.

It follows from the above that, where the knife is suitably adapted, reflective symmetry like that of the wear insert 22 and 180 degree rotational symmetry like that of the wear insert 50 could be combined to produce a wear insert having four wear surfaces that can be selected by either or both turning or flipping the wear insert. Accordingly, it is not a requirement of the invention that a double-sided wear insert have only two wear surfaces.

Figure 14:
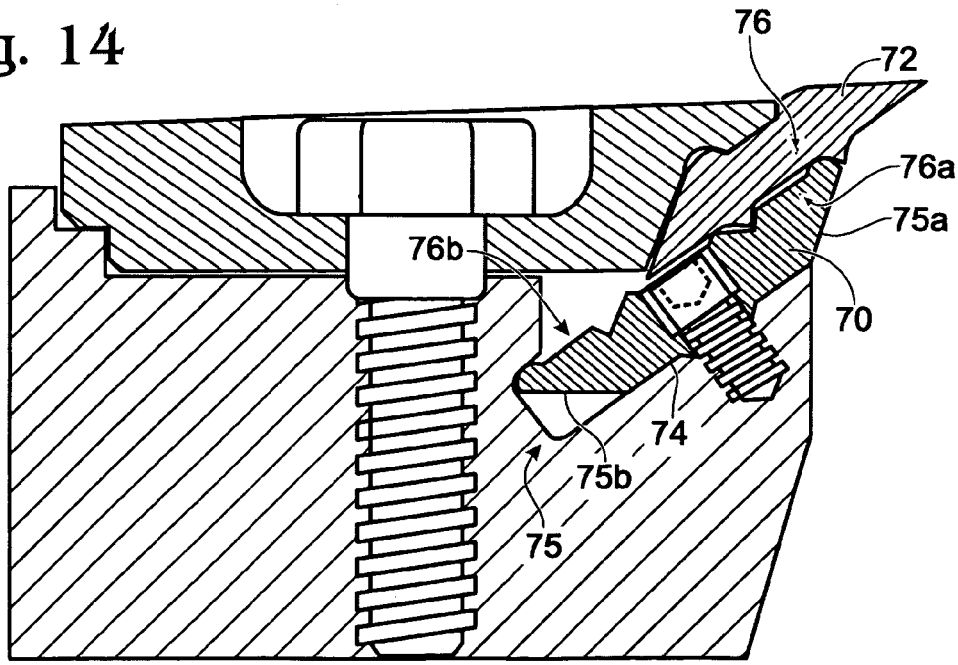
FIG. 14 is a cross-sectional view of a third knife assembly including another double-sided wear insert for use with an alternative knife.

FIG. 14 shows a double-sided wear insert 70 having reflective symmetry suitable for use with another preferred prior art knife described in Schmatjen, U.S. Pat. No. 5,819,826, incorporated by reference herein. The wear insert 70 has a holder-indexing feature 74, two wear surfaces 75, namely 75*a*, 75*b*, and two knife-indexing features 76, namely 76*a*, 76*b*, functioning as described above for the equivalent features of the wear insert 22. The construction of a corresponding double-sided wear insert having rotational symmetry will be readily apparent in view of the discussion above concerning the wear insert 50.

It is to be understood that, while a specific double-sided wear insert has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A wear insert for a knife assembly, where the knife assembly includes a knife, a clamp, and a holder, where the wear insert is elongate and defines a centrally disposed, elongate axis EB, and a plane of symmetry POS of the wear insert, where the wear insert further defines a reference plane perpendicular to the POS, and where the reference plane and the POS intersect along the axis EB, the POS extending in a first direction above the reference plane and in a second, opposite direction below the reference plane, the wear insert comprising:

a top-side surface for receiving the knife;

a bottom-side surface for receipt by the holder, said bottom-side surface including a first holder-indexing feature that includes at least one of (a) a projection and (b) a recess for indexing the wear insert to the holder;

a first wear surface at a first end of the wear insert; and a second wear surface at a second end of the wear insert spaced apart from said end, said first wear surface providing for a first impact angle in a first operably mounted position of the wear insert in the knife assembly such that said top-side surface faces in the first direction and said bottom-side surface faces in the second direction, and in which said first wear surface is exposed to chips being cut by the knife, said first wear surface defining a first impact angle, in said first operably mounted position, relative to the reference plane that differs substantially from 90 degrees, the wear insert being adapted for removal from the knife assembly and replacement therein in a second operably mounted position in the knife assembly in which said second wear surface, instead of said first wear surface, is exposed to chips being cut by the knife, said second wear surface defining in said second operably mounted position a second impact angle for the wear insert relative to the reference plane that is substantially equal to said first impact angle, wherein the wear insert is exchangeable between said first and second operably mounted positions by either (c) turning the wear insert end-for-end and leaving said top-side surface facing in said first direction or (d) flipping the wear insert so that said top-side surface faces in said second direction.

2. The wear insert of claim 1, wherein said wear insert is exchangeable between said first and second operably mounted positions by (c), the wear insert including two substantially identical knife-indexing features on said upper side, said knife-indexing features each being complementary to a corresponding indexing feature of the knife, for indexing the knife to the wear insert.

3. The wear insert of claim 1, wherein said wear insert is exchangeable between said first and second operably mounted positions by (d), the wear insert including two substantially identical knife-indexing features, one of said knife-indexing features on said upper side and the other of said knife-indexing features on said lower side, said knife-indexing features each being complementary to a corresponding indexing feature of the knife, for indexing the knife to the wear insert, and wherein said upper side includes a second holder-indexing feature substantially identical to said first holder-indexing feature for indexing the wear insert to the holder.

4. The wear insert of claim 3, wherein said wear surfaces extend in both said first and second directions.

5. The wear insert of claim 3, wherein said first and second holder-indexing features have reflective symmetry about a plane of symmetry POS of the wear insert that passes through the axis EB.

6. The wear insert of claim 5, wherein said wear surfaces extend in both said first and second directions.

7. The wear insert of claim 3, wherein said first and second holder-indexing features do not have reflective symmetry about a plane of symmetry POS of the wear insert that passes through the axis EB.

8. The wear insert of claim 7, where the wear insert further defines a reference plane, perpendicular to the POS, and where the reference plane and the POS intersect along the axis EB, the POS extending in a first direction above the reference plane and in a second, opposite direction below the reference plane, wherein said wear surfaces extend in both said first and second directions.

9. The wear insert of claim 8, wherein at least one of said wear surfaces is harder or more wear resistant than at least some portions of the holder.

10. The wear insert of claim 7, wherein at least one of said wear surfaces is harder or more wear resistant than at least some portions of the holder.

11. The wear insert of claim 6, wherein at least one of said wear surfaces is harder or more wear resistant than at least some portions of the holder.

12. The wear insert of claim 5, wherein at least one of said wear surfaces is harder or more wear resistant than at least some portions of the holder.

13. The wear insert of claim 4, wherein at least one of said wear surfaces is harder or more wear resistant than at least some portions of the holder.

14. The wear insert of claim 3, wherein at least one of said wear surfaces is harder or more wear resistant than at least some portions of the holder.

15. The wear insert of claim 2, wherein at least one of said wear surfaces is harder or more wear resistant than at least some portions of the holder.

16. The wear insert of claim 1, wherein at least one of said wear surfaces is harder or more wear resistant than at least some portions of the holder.

17. The wear insert of claim 15, wherein each of said knife-indexing features defines in cross-section a contour that is a smoothly varying arc.

18. The wear insert of claim 17, wherein said arcs are circular portions.

19. The wear insert of claim 14, wherein each of said knife-indexing features defines in cross-section a contour that is a smoothly varying arc.

20. The wear insert of claim 19, wherein said arcs are circular portions.

21. The wear insert of claim 13, wherein each of said knife-indexing features defines in cross-section a contour that is a smoothly varying arc.

22. The wear insert of claim 21, wherein said arcs are circular portions.

23. The wear insert of claim 12, wherein each of said knife-indexing features defines in cross-section a contour that is a smoothly varying arc.

24. The wear insert of claim 23, wherein said arcs are circular portions.

25. The wear insert of claim 11, wherein each of said knife-indexing features defines in cross-section a contour that is a smoothly varying arc.

26. The wear insert of claim 25, wherein said arcs are circular portions.

27. The wear insert of claim 10, wherein each of said knife-indexing features defines in cross-section a contour that is a smoothly varying arc.

28. The wear insert of claim 27, wherein said arcs are circular portions.

29. The wear insert of claim 9, wherein each of said knife-indexing features defines in cross-section a contour that is a smoothly varying arc.

30. The wear insert of claim 29, wherein said arcs are circular portions.

31. The wear insert of claim 8, wherein each of said knife-indexing features defines in cross-section a contour that is a smoothly varying arc.

32. The wear insert of claim 31, wherein said arcs are circular portions.

33. The wear insert of claim 7, wherein each of said knife-indexing features defines in cross-section a contour that is a smoothly varying arc.

34. The wear insert of claim 33, wherein said arcs are circular portions.

35. The wear insert of claim 6, wherein each of said knife-indexing features defines in cross-section a contour that is a smoothly varying arc.

36. The wear insert of claim 35, wherein said arcs are circular portions.

37. The wear insert of claim 5, wherein each of said knife-indexing features defines in cross-section a contour that is a smoothly varying arc.

38. The wear insert of claim 37, wherein said arcs are circular portions.

39. The wear insert of claim 4, wherein each of said knife-indexing features defines in cross-section a contour that is a smoothly varying arc.

40. The wear insert of claim 39, wherein said arcs are circular portions.

41. The wear insert of claim 3, wherein each of said knife-indexing features defines in cross-section a contour that is a smoothly varying arc.

42. The wear insert of claim 41, wherein said arcs are circular portions.

43. The wear insert of claim 2, wherein each of said knife-indexing features defines in cross-section a contour that is a smoothly varying arc.

44. The wear insert of claim 43, wherein said arcs are circular portions.

* * * * *